US005220976A

United States Patent [19]

Gunter

[11] Patent Number: 5,220,976

[45] Date of Patent: Jun. 22, 1993

[54] SAFETY HARNESS

[76] Inventor: Larry W. Gunter, 615 Sand Pit Rd., Leesville, S.C. 29070

[21] Appl. No.: 962,174

[22] Filed: Oct. 15, 1992

Related U.S. Application Data

[63] Continuation of Ser. No. 681,291, Apr. 8, 1991, abandoned.

[51] Int. Cl.[5] ..... A62B 35/00

[52] U.S. Cl. ..... 182/3; 244/151 R

[58] Field of Search ..... 182/3; 244/151 R

[56] References Cited

U.S. PATENT DOCUMENTS

| | | | |
|---|---|---|---|
| 1,857,375 | 5/1932 | Hoffman | 244/151 R |
| 2,605,065 | 7/1952 | Wilkins | 244/151 R X |
| 2,643,836 | 6/1953 | Carroll | 244/151 R |
| 2,979,153 | 4/1961 | Hoagland et al. | 182/3 |
| 3,154,272 | 10/1964 | Gold | 244/151 R |
| 3,321,247 | 5/1967 | Dillender | 297/389 |
| 3,424,134 | 1/1969 | Rosenblum | 244/151 R |
| 3,701,395 | 10/1972 | Theobald | 182/3 |
| 4,177,877 | 12/1979 | Gallinati | 182/3 |
| 4,273,216 | 6/1981 | Weissman | 182/3 |
| 4,593,788 | 6/1986 | Miller | 182/3 |
| 4,625,335 | 12/1986 | Vinai | 2/69 |
| 4,666,017 | 5/1987 | Zimmerman | 182/3 |
| 4,738,413 | 4/1988 | Spinosa et al. | 244/151 R |
| 4,746,084 | 5/1988 | Strong | 244/151 R |
| 4,850,554 | 7/1989 | Strong | 244/151 R |

FOREIGN PATENT DOCUMENTS

| | | | |
|---|---|---|---|
| 967531 | 5/1975 | Canada | 244/151 R |
| 1233761 | 5/1971 | United Kingdom | 182/3 |

*Primary Examiner*—Alvin C. Chin-Shue

*Attorney, Agent, or Firm*—Harold M. Dixon; William R. Moser; Richard E. Constant

[57] ABSTRACT

A safety harness to be worn by a worker, especially a worker wearing a plastic suit thereunder for protection in a radioactive or chemically hostile environment, which safety harness comprises a torso surrounding portion with at least one horizontal strap for adjustably securing the harness about the torso, two vertical shoulder straps with rings just forward of the of the peak of the shoulders for attaching a life-line and a pair of adjustable leg supporting straps releasibly attachable to the torso surrounding portion. In the event of a fall, the weight of the worker, when his fall is broken and he is suspended from the rings with his body angled slightly back and chest up, will be borne by the portion of the leg straps behind his buttocks rather than between his legs. Furthermore, the supporting straps do not restrict the air supplied through hoses into his suit when so suspended.

4 Claims, 2 Drawing Sheets

Fig. 3
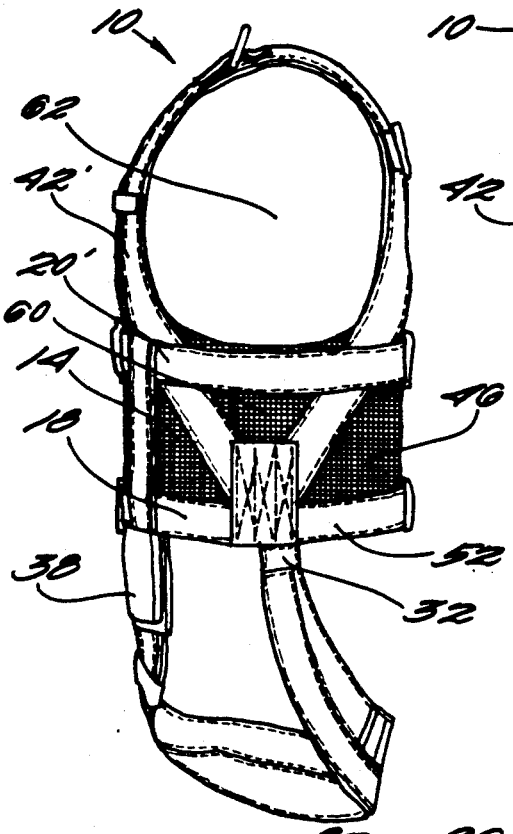
Fig. 4
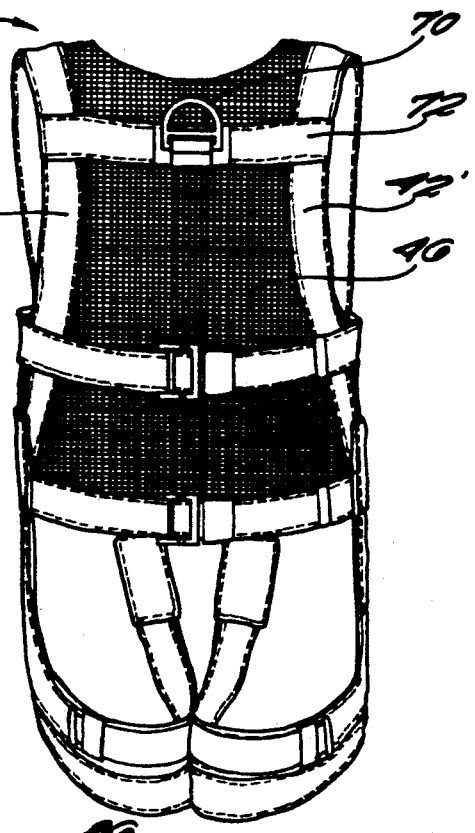
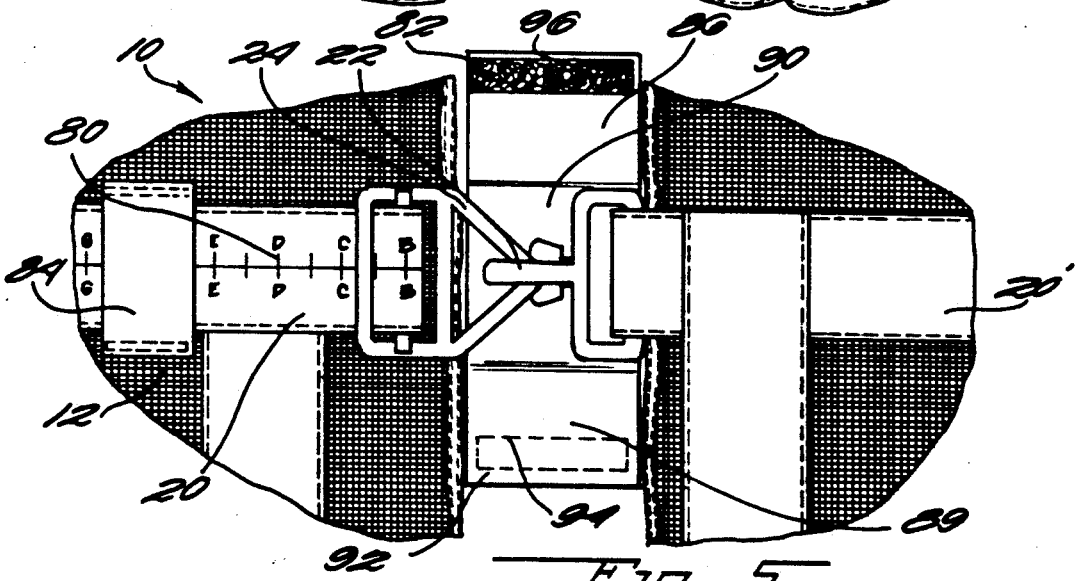
Fig. 5

SAFETY HARNESS

This is a continuation of application Ser. No. 07/681,291 filed Apr. 8, 1991, abandoned.

BACKGROUND OF THE INVENTION

1. Field of the Invention

The present invention relates to safety harnesses. More particularly the present invention relates to a safety harness to be worn over safety clothing that includes supplied air. The United States Government has rights in this invention pursuant to Contract No. DE-AC09-89SR18035 between the U.S. Department of Energy and Westinghouse Savannah River Company.

2. Discussion of the Background

When a person is engaged in an activity where there is a possibility of the person falling, such as, for example, while the person is working on scaffolding or the like, as in window washing or construction, that person should take appropriate safeguards against injury. Vests, belts, harnesses and safety suits attached to a tether or life-line are devices that attempt to provide the protection needed but each has its own shortcomings. Safety vests are cumbersome and heavy, getting in the way of the work to be done and causing the person discomfort because of heat retention and constriction. Safety belts, while not so hot or bulky as vests, often cause injury to the midsection or the chest in the event of a fall because the resulting forces necessary to arrest the fall are localized. Safety suits are quite bulky and retain heat; they are difficult to get into and the leg straps can tighten and injure the crotch when the tether-line stops a fall. In certain situations these problems are compounded by the need to wear a "plastic suit." A plastic suit is a one or two piece garment which covers the wearer from head to foot, made of an impervious material as protection from a radioactive or chemically hostile environment. Air is forced through the suit for breathing and to keep the wearer cool. Air is provided from a remotely located pumping device through flexible tubing fed into the plastic suit. Internally, several branching lines deliver air to the suit extremities. The flow of air, which is normally controlled by a regulator located in the region of the middle of the back of the plastic suit, is restricted when a safety belt or vest is worn over the plastic suit. If the wearer happens to fall, a safety belt or vest stopping the fall could restrict the supply of air, leaving the wearer with no fresh air circulation.

There is a need for a safety harness which will not interfere with the work of the wearer or with the wearing of a plastic suit and will be comfortable and nonrestricting should the wearer happen to fall while wearing the safety harness.

SUMMARY OF THE INVENTION

According to its major aspects, the present invention, a safety harness, includes a torso-surrounding portion comprising a plurality of interconnected straps, preferably attached to a mesh material to form a vest-like garment with a first side vest portion, a second side vest portion, and a back vest portion. The straps include adjustable horizontal securing straps front and back, vertical straps to which are affixed, in one embodiment, rings of metal or other suitable material for attaching life-lines which will arrest the wearer in the event of a fall. The safety harness further comprises leg straps which are designed to bear the bulk of the weight of the wearer in the event of a fall. These leg straps are adjustable and are securely attached to the torso-surrounding portion. All adjustable straps have quick release closures and calibration markings for customizing the fit of the harness. In another embodiment of the present invention, a single ring is located centrally along a horizontal strap at the upper back area of the back vest portion. Both embodiments allow freedom of movement, spread the forces incurred in arresting a fall, and allow the continued, unrestricted supply of air into and out of a plastic suit which may be worn beneath the safety harness.

The mesh of the torso surrounding portion is a feature of the present invention. Mesh reduces weight and allows air to flow through the vest without restraint. The safety harness is thus comparatively comfortable to wear, weighing only a few pounds, and is not heat retentive.

Another feature of the present invention is the adjustability of the horizontal straps. The adjustability allows different sized workers to wear the same safety harness comfortably.

A related feature are the calibration markings on each adjustable strap. The markings allow the safety harness to be quickly and easily adjusted by an individual to his needs simply by using the markings corresponding to his personal dimensions. This ease of fitting is especially important when the wearer must enter a radioactive environment where radioactive exposure time is limited and don the harness before beginning his job. The wearer may enter, don the safety harness, and quickly make adjustments to the previously noted markings, saving time for the job at hand.

Another feature of the present invention is the design of the leg straps. The leg straps are designed to be adjusted so that in the event of a fall, the bulk of the weight on the arresting life-lines is carried by the gluteus maximus and the back of the upper thigh rather than on the inside of the leg. This design reduces the possibility of injury to the crotch.

Yet another feature of an embodiment of the present invention is the two vertical straps carrying the life-line receiving rings. The rings are affixed to the vertical straps slightly in front of the peak of the shoulders of the harness, and do not interfere with the regulator or air supply to a plastic suit which may be worn beneath the harness. The placement of the rings in conjunction with the attachment of the leg straps to the vest portion causes the life-lines and safety harness to receive the bulk of the wearer's weight under the buttocks and allows retrieval of a fallen wearer in a practically vertical alignment, an important feature when working in areas of limited space, such as manhole openings and the like. Two life-lines may be attached to the safety harness, so that even if one life-line were to break, one would still remain. Additionally, a life-line of inverted-Y shape may be attached to the two D-rings, or only one life-line may be used if using a single D-ring harness. This feature provides flexibility and adaptability to the type of work of the wearer.

A related feature of another embodiment is the single ring affixed to the midsection of the upper back region. This embodiment is preferred when only one life-line is available or when that configuration best suits the needs of the wearer. Any forces incurred in arresting a fall will be spread to both sides of the safety harness and to the leg straps approximately evenly.

Another feature of the present invention is the coverings over the primary hooks of the vest portion and leg straps. These coverings have the advantage of reducing the possibility that the metal hooks or closures will accidentally be opened or exposed to electrical lines.

The adjustable horizontal straps across the back of the safety harness are features of the present invention which allow even more customization for a more comfortable fit.

Other features and advantages of the present invention will be apparent to those skilled in the art from a careful reading of the Detailed Description of Preferred Embodiments presented below and accompanied by the drawings.

BRIEF DESCRIPTION OF THE DRAWINGS

In the drawings,

FIG. 3 is a side view of the embodiment of FIG. 1;

FIG. 4 is a back view of another embodiment of the present invention, a safety harness; and FIG. 5 is a close-up partial view of the primary snap of the present invention.

DETAILED DESCRIPTION OF PREFERRED EMBODIMENTS

Figure 1:
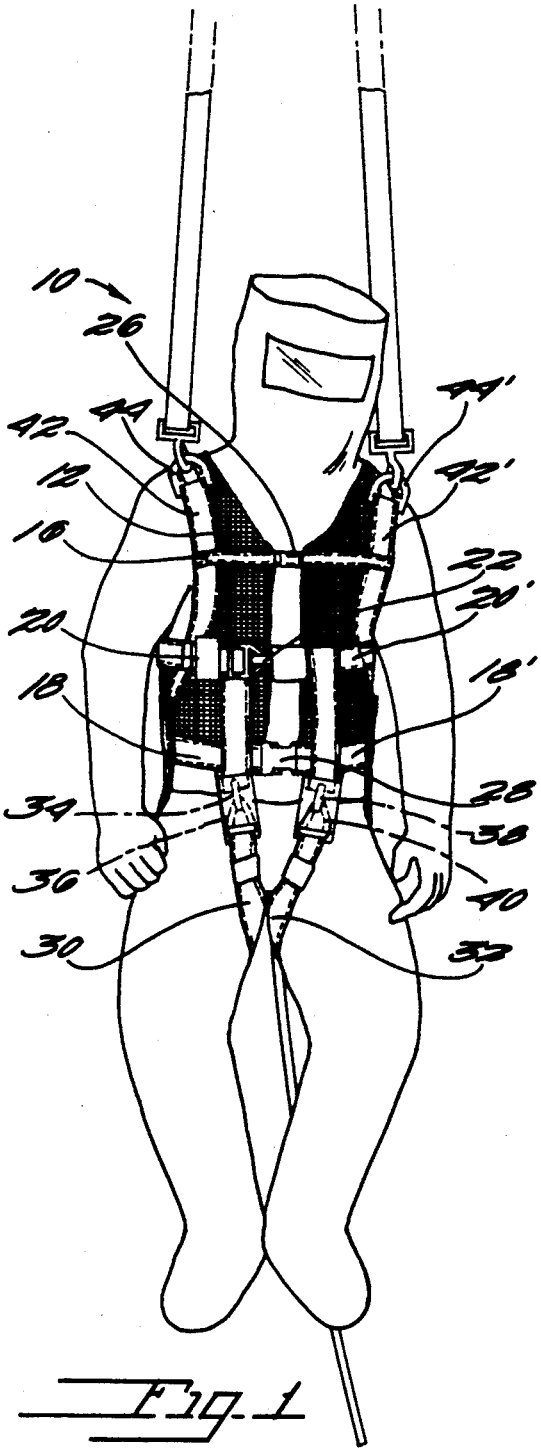
FIG. 1 is a frontal view of one embodiment of the present invention, a safety harness.

Referring now to the drawings, wherein like reference numerals refer to like parts throughout the several views, reference numeral 10 refers generally to the present invention, a safety harness. In FIG. 1, a front view of safety harness 10 shows a torso surrounding portion comprising a first side vest portion 12 and a second side vest portion 14. Both first and second side vest portions 12, 14 form a foundation to which straps are attached, as will be described presently, and are preferably made in the main of a mesh material or other suitable, breathable material. First side vest portion 12 includes a first horizontal strap 16 crossing the upper chest area, a second horizontal strap 18 crossing the waist area and a third horizontal strap 20 located midway between first horizontal strap 16 and second horizontal strap 18, crossing the lower chest area. Second side vest portion 14 has corresponding first horizontal strap 16', second horizontal strap 18', and third horizontal strap 20' positioned to align with first horizontal strap 16, second horizontal strap 18, and third horizontal strap 20, respectively. Third horizontal strap 20 is joined to third horizontal strap 20' by a primary hook 22. Hook 22 hooks onto a hook ring 24 adjustably mounted on third horizontal strap 20'. First horizontal straps 16, 16' are secured together by a latch 26, while second horizontal straps 18, 18' are secured together by a similar latch 28. Latch 26 and latch 28 may be of any suitable design such that at least one strap is adjustable in length therethrough. Latch 26 and latch 28 are preferably of a quick-release design, easily releasable with one hand. Latch 28 may be of a larger or sturdier construction than latch 26 because latch 28 will receive more stresses and strains than latch 26.

Safety harness 10 further comprises a first leg strap 30 depending from first side vest portion 12 and a second leg strap 32 depending from second side vest portion 14. First leg strap 30 attaches to first side vest portion 12 by a hook 34 affixed to first side vest portion 12 which hooks onto a hook ring 36 adjustably mounted on first leg strap 30. Second leg strap 32 attaches to second side vest portion 14 by a hook 38 affixed to second side vest portion 14 which hooks onto a hook ring 40 adjustably mounted on second leg strap 32. Each hook and hook ring combination is covered by a protective covering to be described in further detail below.

First side vest portion 12 has sewn to it a vertical strap 42 carrying a life-line ring 44 at the shoulder area of first side vest portion 12. A similar vertical strap 42' is sewn to second side vest portion 14 and carries a similar life-line ring 44' at the shoulder area of second side vest portion 14. Rings 44, 44' are made of stainless steel or other suitable material and are oriented on vertical straps 42, 42' for ease of attachment of snaps, hooks, clamps, clasps, or the like of the life-line(s). Upon arrest of a fall by the life-lines, the weight of the wearer will be distributed in an approximately vertical direction through rings 44, 44' down through vertical straps 42, 42' on either side of the wearer's torso, to leg straps 30, 32 under the wearer's buttocks, causing the wearer to "sit" into leg straps 30, 32. The wearer will then be suspended in an approximately vertical position, making retrieval or hoisting of the wearer through narrow passageways less difficult.

Figure 2:
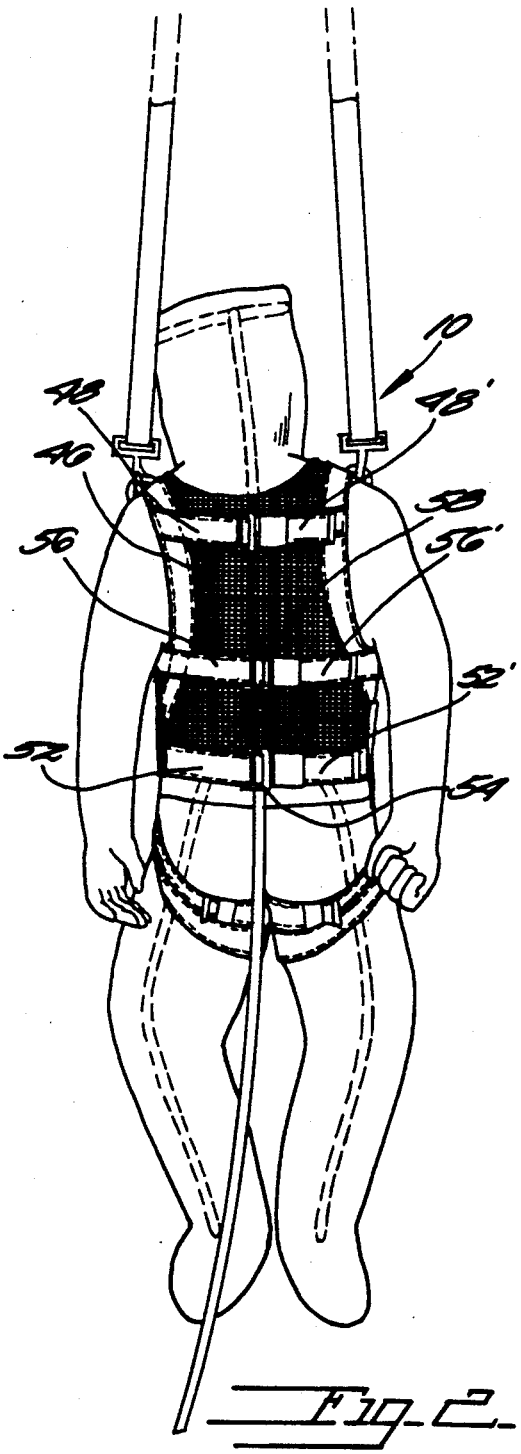
FIG. 2 is a back view of the embodiment of FIG. 1.

FIG. 2 is a back view of one embodiment of safety harness 10. Safety harness 10 comprises a back vest portion 46 preferably made of the same lightweight, strong mesh material as first and second side vest portions 12, 14. A horizontal shoulder strap 48 adjustably joins a horizontal shoulder strap 48' through a tension tightening buckle 50. Horizontal shoulder straps 48, 48' stretch across the upper back of the wearer paralleling horizontal straps 16, 16'. A horizontal waist strap 52 adjustably joins a horizontal waist strap 52' through a tension tightening buckle 54. Horizontal waist straps 52, 52' are located at the lower region of back vest portion 46 and stretch across the back at the waist, meeting horizontal straps 18, 18'. A horizontal strap 56 adjustably joins a horizontal strap 56' through a tension tightening buckle 58 at the middle of back vest portion 42. Buckle 58 may be of heavier construction than either buckle 50 or buckle 54. Buckle 58 may receive more stress and strain in a fall than either buckle 50 or buckle 54 due to its location. Straps 48', 52', and 56' may be threaded through keepers (not shown) sewn to back vest portion 42 after adjustments to fit have been made so that no ends are loose to become entangled with each other or the life-line(s). Back portion 46 has sufficient room to allow the regulator attached to the back of a plastic suit space to receive air tubing without constriction.

A side view of safety harness 10 is shown in FIG. 3. Front side vest portion 14 with vertical strap 42' joins back vest portion 46 at 60 and is preferably contiguous with back vest portion 46. Vertical strap 42' follows the curve of the shoulder at the armhole 62 and joins a reinforcement panel 64 at the waist of vest portion 14. Reinforcement panel 64 is sewn to second side vest portion 14 and back vest portion 46 at 60 as well as horizontal strap 18' and horizontal waist strap 52. Also sewn to reinforcement panel 64 is one end of leg strap 32. This weight of the fallen wearer is directed through rings 44, 44', along straps 42, 42', through reinforcement panel 64, 64' (not shown), and into leg straps 30, 32 so that the wearer is suspended from the life-lines in a "seated" position on his buttocks in leg straps 30, 32. Hook 38 is sewn to second side vest portion 14 by a hook-securing strap 66 sewn to second side vest portion 14 from horizontal strap 20' down to horizontal strap 18'. A symmetrical arrangement exists on the other side of safety harness 10 with respect to vertical strap 42 on first side vest portion 12 and leg strap 30 (best seen in FIG. 1).

FIG. 4 is a back view of a second embodiment of the safety harness 10. This embodiment comprises a single life-line ring 70 attached to a horizontal strap 72 sewn to back vest portion 46 between vertical straps 42, 42'. This embodiment may be preferred when only one life-line is available. Vertical straps 42, 42' may also carry life-line rings 44, 44' (FIG. 1) in this embodiment to increase the adaptability of safety harness 10 to various configurations of life-lines.

FIG. 5 is a close-up of hook 22 on horizontal straps 20, 20' at the front of safety harness 10. Hook 22 hooks onto hook ring 24, as shown, and horizontal strap 20 is adjusted by reference to calibration markings 80 located thereon. After adjustment is complete, that portion of horizontal strap 20 that has been pulled through hook ring 24 is threaded through keeper 84 sewn to first side vest portion 12. Calibration markings 80 may be any suitable system of indicating variations in size or fit, such as numerals, letters, color bars, holes or the like. Calibration markings may be placed on each of the adjustable straps of safety harness 10 in order to assist in quickly customizing the fit of safety harness 10 to each individual wearer. Hook 22 and hook ring 24 are preferably surrounded by a protective covering 82 (shown opened in FIG. 5 and closed in FIG. 1). Protective covering 82 comprises an upper flap 86 and a lower flap 88 connected by a backing portion 90. Backing portion 90 lies behind hook 22 and hook ring 24. In use, lower flap 88 is folded up and in front of hook 22 and hook ring 24, exposing at its distal end 92 a panel of adhesive material 94. Upper flap 86 is folded down and over lower flap 88 so that a panel of complimentary adhesive material 96 contacts adhesive material 94 of lower flap 88 to securely surround and protect hook 22 and hook ring 24. The adhesive material could be VELCRO. Similar protective coverage may surround the hooks of both leg straps also as well as any other metallic item which should be protected from exposure to thermal, electrical or corrosive conditions.

In use, a person wishing to wear safety harness 10 dons harness 10 as any vest. Horizontal straps 16,16' are brought together in front, joined with latch 26, and adjusted to fit comfortably according to the markings on strap 16. Next, horizontal straps 18, 18' are brought together, joined by latch 28, and adjusted comfortably according to the markings on strap 18. Then, horizontal straps 20, 20' are brought together, joined by hooking primary hook 22 onto hook ring 24, adjusting accordingly with measuring means 80 on strap 20, and closing protective cover 82 over hook 22 and hook ring 24. Finally, each leg strap 30, 32 is hooked to its respective hook 34,38 and each hook is covered by closing the protective covering thereabout. If further adjustment to safety harness 10 is desired, any or all horizontal back straps may be adjusted. When safety harness 10 is suitably adjusted, the lifeline(s) are attached and the wearer may proceed about his business.

It will be apparent to those skilled in the art that many changes and substitutions can be made to the preferred embodiment herein described without departing from the spirit and scope of the present invention which is defined by the appended claims.

What is claimed is:

1. A safety harness to be worn by a user and for use with two lifelines, said harness comprising:

a vest dimensioned for covering the torso of said user and made of a mesh material, said vest having a front and a back:

at least two horizontal straps attached to said vest, each horizontal strap of said at least two horizontal straps having two ends and encircling said wearer, said two ends terminating in closures carried on said front of said vest so that said straps can be fastened together about the torso of said user, said each horizontal strap having means for adjusting tension of said horizontal strap to conform to the body of said wearer, said adjusting means carried on the back of said vest, said horizontal straps held in relative position by said vest and carrying calibrated markings so that said user can customize the fit of said harness;

a set of vertical straps attached to said vest, said vertical straps held in relative position by said vest, said vertical straps depending from said vest to encircle the legs of said user; and means attached to said vertical straps for connecting said harness to said two lifelines just forward of the peak of the shoulders of said user.

2. The safety harness as recited in claim 1, wherein said vest is made of a fabric mesh.

3. The safety harness as recited in claim 1, wherein said at least two horizontal straps further comprises three straps and said set of vertical straps further comprises two vertical straps.

4. The safety harness as recited in claim 1, wherein said said closures include a covering made of an electrically insulated material.

* * * * *